US010820757B2

(12) United States Patent
Chung

(10) Patent No.: US 10,820,757 B2
(45) Date of Patent: Nov. 3, 2020

(54) SHOWER SYSTEMS AND METHODS

(71) Applicant: Kohler Co., Kohler, WI (US)

(72) Inventor: Chanseol Chung, Milwaukee, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/182,377

(22) Filed: Nov. 6, 2018

(65) Prior Publication Data

US 2019/0133382 A1 May 9, 2019

Related U.S. Application Data

(60) Provisional application No. 62/582,400, filed on Nov. 7, 2017.

(51) Int. Cl.
*A47K 3/28* (2006.01)
*B05B 1/00* (2006.01)

(52) U.S. Cl.
CPC ..... *A47K 3/283* (2013.01); *A47K 3/281* (2013.01); *B05B 1/00* (2013.01)

(58) Field of Classification Search
CPC ..... A47K 3/283; A47K 3/181; B05B 1/262; B05B 1/265; B05B 1/267
USPC ..... 4/605; 239/498, 500, 461
See application file for complete search history.

(56) References Cited

U.S. PATENT DOCUMENTS 530,464 A 12/1894 Van Dyke
622,132 A 3/1899 Dungan
1,434,757 A * 11/1922 Thomas ..... B05B 1/267 239/498
1,492,750 A * 5/1924 Rogers ..... F24F 13/06 454/292
1,504,000 A * 8/1924 Simmons ..... B05B 1/18 239/498
1,895,307 A * 1/1933 Emil Beck ..... B05B 1/18 239/499
2,527,852 A * 10/1950 Rinehimer ..... A47K 3/283 4/596
2,539,976 A * 1/1951 Samson ..... A47K 3/281 239/511
2,550,456 A * 4/1951 De Flon ..... B05B 1/265 239/498
2,601,655 A 6/1952 Young
2,639,947 A * 5/1953 Schaub ..... B01D 3/008 239/500
2,900,139 A * 8/1959 Hensley, Jr. ..... B05B 1/267 239/499
2,915,252 A * 12/1959 Umbricht ..... B05B 1/262 239/500
2,994,484 A * 8/1961 Stearns ..... B05B 1/265 239/224
3,465,968 A * 9/1969 Halpern ..... B05B 1/262 239/504
3,847,159 A 11/1974 Hofer
4,071,193 A * 1/1978 Sternby ..... B01D 35/28 239/11

(Continued)

*Primary Examiner* — Benjamin R Shaw
(74) *Attorney, Agent, or Firm* — Foley & Lardner LLP

(57) ABSTRACT

A shower system includes a panel. The panel is configured to be mounted on a ceiling within a showering enclosure. The panel includes a deflection surface that includes a plurality of deflection features that are configured to redirect water that is incident upon the deflection surface at an upward angle toward a location directly beneath the panel.

20 Claims, 10 Drawing Sheets

(56) References Cited

U.S. PATENT DOCUMENTS 4,700,893 A * 10/1987 Bugler, III ..... F28F 25/06 239/498
4,912,782 A * 4/1990 Robbins ..... B05B 1/20 239/520
4,914,770 A * 4/1990 Baus ..... A47K 3/36 4/596
4,993,201 A * 2/1991 Bunyard ..... A47K 3/284 4/596
5,137,214 A * 8/1992 Mallery ..... A63J 5/00 239/11
5,142,713 A * 9/1992 Makool ..... A61H 33/10 4/525
5,224,652 A * 7/1993 Kessler ..... B05B 3/0486 239/211
5,544,369 A * 8/1996 Roberts ..... A47K 3/325 4/599
5,642,959 A * 7/1997 Greferath ..... A47K 3/36 4/596
5,671,488 A * 9/1997 Greferath ..... A47K 3/36 4/596
5,974,604 A 11/1999 Barnea
6,119,965 A * 9/2000 Chang ..... B05B 1/3426 239/467
6,895,609 B2 * 5/2005 Ingram ..... A47K 3/04 4/538
7,611,072 B2 * 11/2009 Peters ..... A61M 11/041 239/13
2006/0207015 A1 * 9/2006 DeBoer ..... B05B 1/207 4/615
2006/0226255 A1 * 10/2006 DeBoer ..... B05B 1/36 239/193
2009/0173388 A1 * 7/2009 Sever ..... E03C 1/08 137/1
2015/0082535 A1 * 3/2015 Parks ..... E03C 1/0408 4/601
2017/0080437 A1 * 3/2017 Brewer ..... A01G 25/00
2017/0189919 A1 * 7/2017 Mei ..... B05B 1/262

* cited by examiner

SHOWER SYSTEMS AND METHODS

CROSS-REFERENCE TO RELATED PATENT APPLICATION

This application claims the benefit of and priority to U.S. Provisional Patent Application No. 62/582,400, filed Nov. 7, 2017, the entire disclosure of which is incorporated herein by reference.

BACKGROUND

The present disclosure relates generally to a shower system. More specifically, the present disclosure relates to a shower system that includes a repositionable shower head and a shower panel.

Generally speaking, a shower head is utilized to spray water down onto a user to facilitate cleansing of the user's body. Typically, shower heads are fixed to a wall and the user moves relative to the shower head to change how and where the water impacts the user. Some conventional shower heads are attached to a vertical wall and spray the water at a downward angle toward the user. Other shower heads are attached to a ceiling and spray the water directly downward onto the user. However, conventional shower heads are not capable of both spraying water from a vertical wall at a downward angle onto a user and from a ceiling directly downward onto the user. As a result, an opportunity exists to improve upon conventional shower heads by providing a shower head that addresses these shortcomings.

SUMMARY

One embodiment relates to a shower system. The shower system includes a panel. The panel is configured to be mounted on a ceiling within a showering enclosure. The panel includes a deflection surface that includes a plurality of deflection features that are configured to redirect water that is incident upon the deflection surface at an upward angle toward a location directly beneath the panel.

Another embodiment relates to a shower system. The shower system includes a panel and a showerhead. The panel is configured to be mounted on a ceiling within a showering enclosure. The panel includes a deflection surface that includes a plurality of deflection features protruding from the deflection surface. Each of the plurality of deflection features is configured to redirect water that is incident upon the deflection surface at an upward angle toward a location directly beneath the panel. At least two of the plurality of deflection features have at least one of an identical size or an identical shape. The showerhead is configured to direct water upward toward the panel at an angle.

Another embodiment relates to a shower system. The shower system includes a panel and a showerhead. The panel is configured to be mounted on a ceiling. The panel includes a deflection surface that includes a plurality of deflection features protruding from the deflection surface. Each of the plurality of deflection features is configured to redirect water that is incident upon the deflection surface at an upward angle toward a location beneath the panel. The showerhead is configured to direct water upward toward the panel at an angle. The deflection surface is configured such that when the water is redirected toward the location. The water interfaces with at least two of the plurality of deflection features.

It is to be understood that both the foregoing general description and the following detailed description are exemplary and explanatory only and are not restrictive of the invention as claimed.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Many showers either utilize a head that is fixed to a wall or a head that may be detached from the wall. These showers are unable to be reconfigured without user input. At best, the user may grasp the head, detach the head, and point the head as desired. Even using this approach, a user is unable to reconfigure a conventional shower to provide water at an angle relative to the user and to provide water straight down onto the user. Because these showers are unable to be reconfigured in this way, users often have to choose between different shower designs at purchase.

Various embodiments described herein are directed to a shower that can propel water at an angle onto to a user and that can propel water straight down onto a user by incorporating a panel assembly within the shower and a shower head assembly that is capable of selectively directing water at the panel assembly. Such a shower would have additional capability compared to other showers and may provide a user with increased satisfaction when using the shower.

Figure 1:
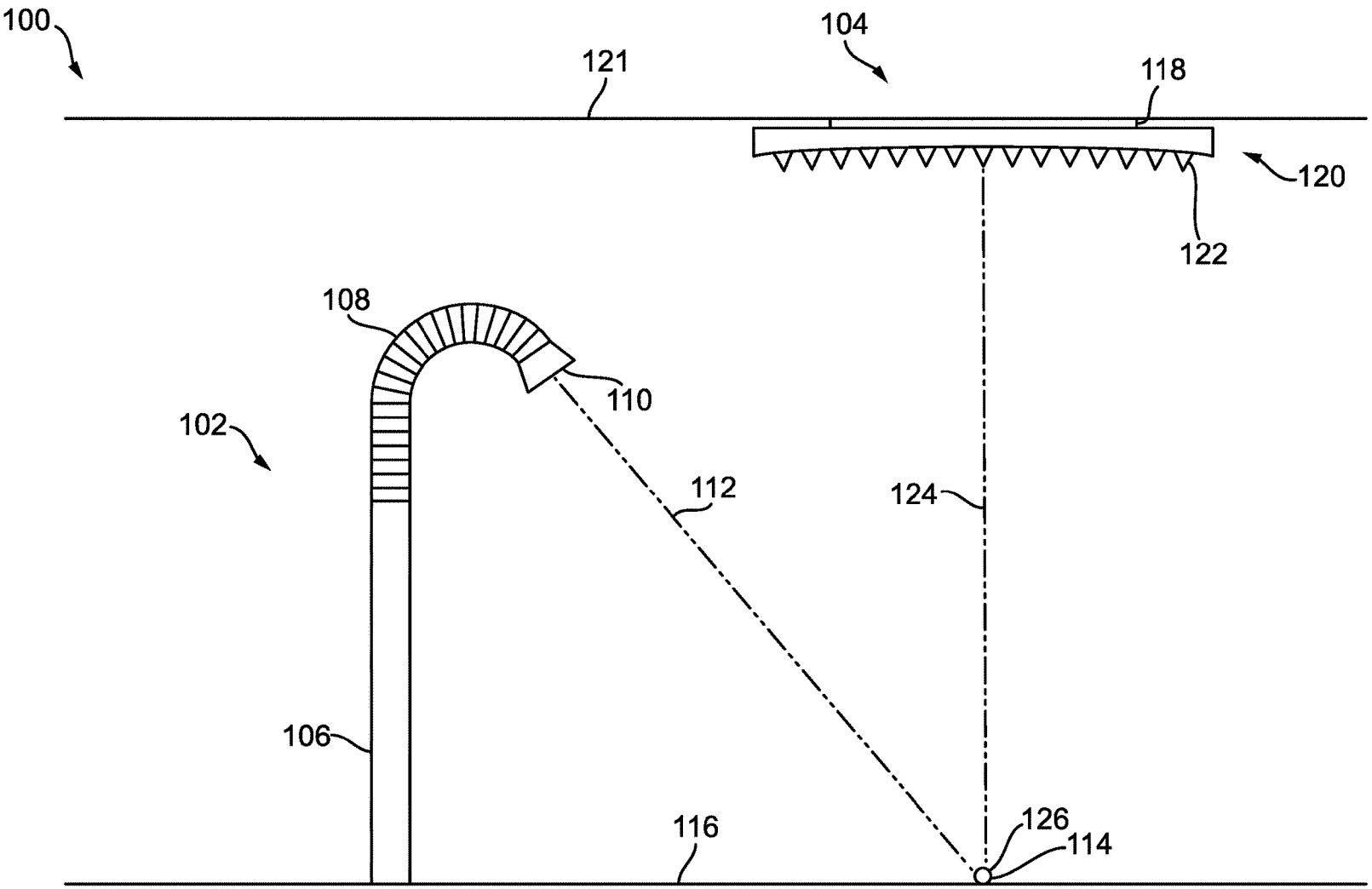
FIG. 1 is a front view of a shower system in a first configuration, according to an exemplary embodiment of the present disclosure.
Figure 2:
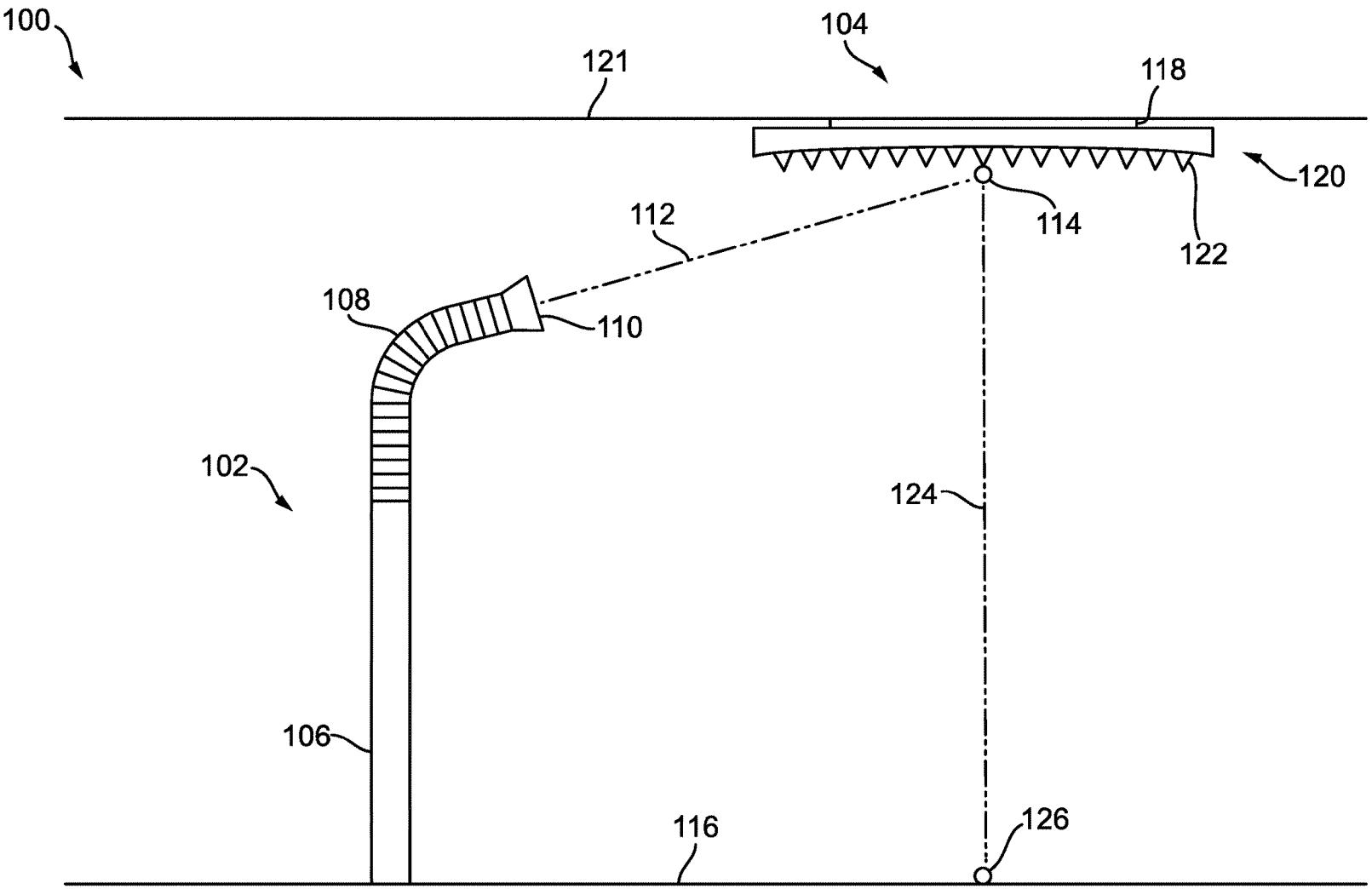
FIG. 2 is a front view of the shower system shown in FIG. 1 in a second configuration, according to an exemplary embodiment of the present disclosure.
Figure 3:
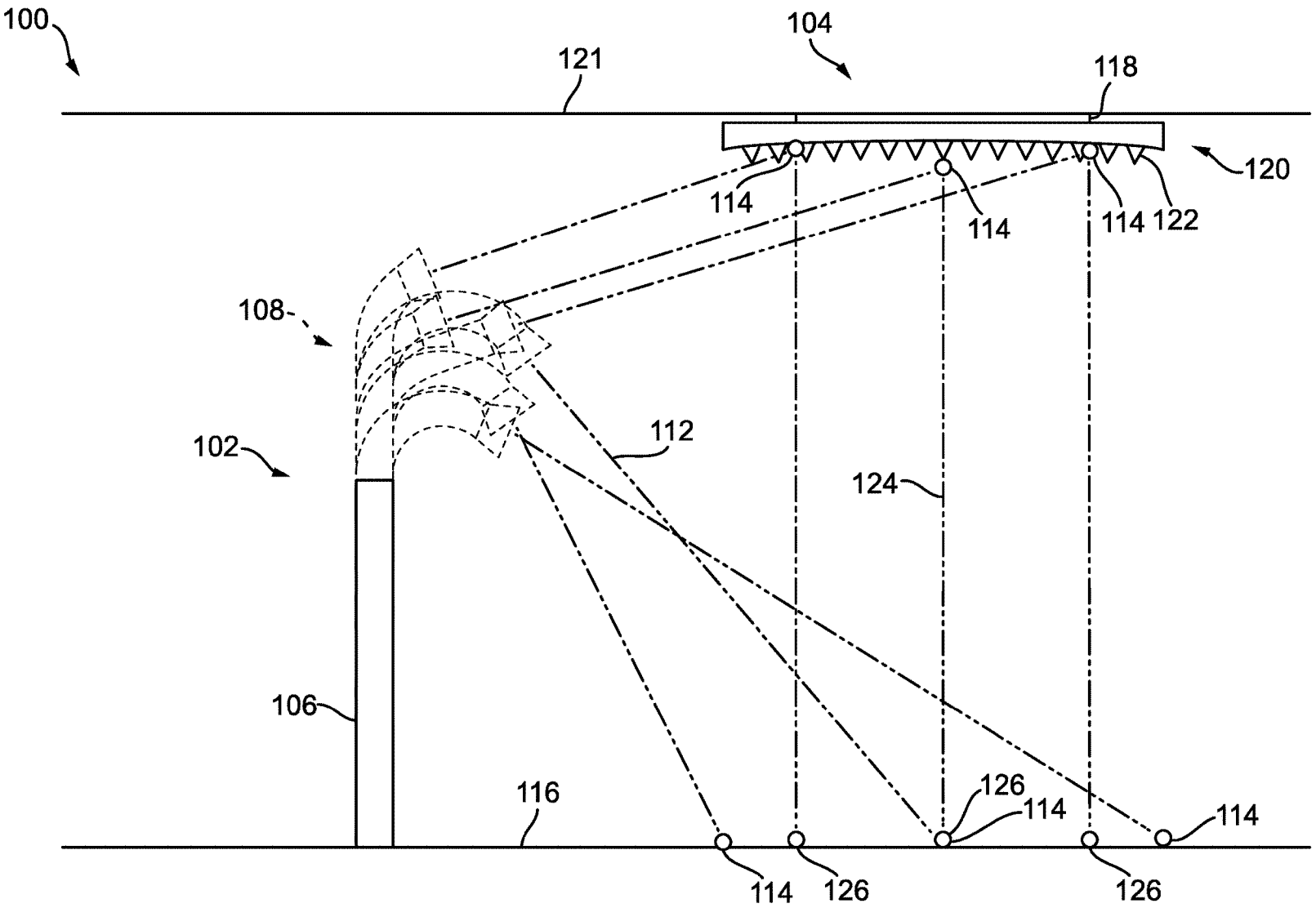
FIG. 3 is a front view of the shower system shown in FIG. 1 in various configurations, according to an exemplary embodiment of the present disclosure.

Referring to FIGS. 1-3, a shower system (e.g., shower assembly, flexible shower assembly, etc.), shown as a shower system 100, is shown. The shower system 100 is utilized by a user (e.g., shower user, individual, homeowner, etc.) to selectively spray (e.g., dispense, eject, propel, etc.) water (e.g., softened water, fluid, etc.). For example, the shower system 100 may be utilized by a user to spray water onto the user or an object (e.g., item to be cleaned, etc.). In this way, the user may utilize the shower system 100 to cleanse the user's body (e.g., hair, etc.) or the object.

The shower system 100 includes a first assembly (e.g., system, head assembly, sprayer assembly, etc.), shown as a shower head assembly 102, and a second assembly (e.g., system, rain panel assembly, spray panel assembly, overhead assembly, etc.), shown as a panel assembly 104. The shower head assembly 102 receives water from a water supply and selectively provides the water from the water supply. For example, the shower head assembly 102 is selectively controllable to provide a desired amount of water from the shower head assembly 102. The shower head assembly 102 includes one or more controls (e.g., handles, knobs, levers, slides, touch screen controls, smart controls, etc.) that control how much water is provided from the shower head assembly 102 and the temperature of the water provided from the shower head assembly 102.

The shower head assembly 102 includes a body (e.g., frame, base, etc.), shown as a body 106, a section (e.g., portion, movable section, flexible section, etc.), shown as a movable head 108, and a nozzle (e.g., ejector, etc.), shown as a sprayer 110. The body 106 is coupled to the movable head 108, which is coupled to the sprayer 110. The body 106 houses internal conduits (e.g., pipes, copper pipes, PVC, tubes, etc.) that provide water from a water source (e.g., water tank, reservoir, hot water, tank, water supply, water main, etc.) to the movable head 108, which provides the water via flexible conduits to the sprayer 110. The sprayer 110 generally provides the water along a trajectory (e.g., path, center line, axis, etc.), shown as a trajectory 112, towards a target (e.g., focal point, aim point, etc.), shown as a target 114. As utilized herein, "target" indicates an area (e.g., of more than 78 square inches, of more than 36 square inches, etc.) where water is provided. A "target" is not a single point with a miniscule area (e.g., of less than 1 square inch, etc.).

The movable head 108 is selectively repositionable between a plurality of configurations (e.g., positions, locations, orientations, etc.). In each different configuration, the movable head 108 provides the water along a different trajectory 112 toward a different target 114. In this way, the user can selectively reposition the movable head 108 between the plurality of configurations to provide the water to different targets 114. To facilitate the selective repositioning of the movable head 108 between the plurality of configurations, the movable head 108 is flexible (e.g., constructed from a flexible body, etc.) and capable of being held in any of the plurality of configurations (e.g., via a locking feature, via detents, via an internal mechanism, etc.).

In an exemplary embodiment, the movable head 108 is configured to transition from a first configuration, as shown in FIG. 1, to a second configuration, as shown in FIG. 2, in response to water flowing through and out of the movable head 108. For example, the movable head 108 may move between configurations once a target parameter (e.g., flow rate, pressure, etc.) of water within the shower head assembly 102 is achieved. In this way, the movable head 108 may move (e.g., articulate, transition, etc.) between configurations automatically and without input from the user (e.g., when the water being propelled from the sprayer 110 obtains a target pressure, etc.).

In another example, a user can selectively reposition the movable head 108 from a first configurations by first grabbing the movable head 108, then causing the movable head 108 to rotate (e.g., by pushing on the movable head 108, by pulling the movable head 108, etc.), causing the movable head 108 to be held in a second configuration, and releasing (e.g., letting go of, etc.) the movable head 108. In this way, the user may cause water to be propelled from the shower head assembly 102 along different trajectories without the user being required to hold onto the shower head. This allows the user to utilize the shower head assembly 102 substantially hands-free once the movable head 108 has been positioned in a target configuration.

The sprayer 110 may be adjustable between a plurality of different spray patterns. Each of the plurality of spray patterns may cause water to be propelled from the sprayer 110 differently. For example, the sprayer 110 may have a pulse spray pattern and a jet spray pattern. The sprayer 110 may automatically enter a preselected spray pattern when the movable head 108 is held in a desired positioned. In some applications, the sprayer 110 can be adjusted between different spray patterns by the user (e.g., by the user rotating the sprayer 110, etc.). While the sprayer 110 is shown as extending from the movable head 108, it is understood that the sprayer 110 may be incorporated within the movable head 108 such that the sprayer 110 is substantially concealed within the movable head 108.

In one embodiment, the body 106 is coupled (e.g., attached, fastened, adhered, etc.) to a surface (e.g., wall, etc.), shown as a floor 116. For example, the body 106 may extend from the floor 116 (e.g., via a flange, etc.). In other applications, the body 106 may extend from a ceiling, a wall, or other similar surface. In still other applications, the body 106 may extend from a structure (e.g., pillar, post, etc.). The body 106 is configured to provide the movable head 108 at a target height. For example, the body 106 may be configured to provide the movable head 108 at a target height that is based on a height of a target user (e.g., consumer, etc.).

The panel assembly 104 includes a body (e.g., frame, base, etc.), shown as a body 118, and a panel (e.g., splash panel, textured panel, plate, deflector, etc.), shown as a panel 120. The body 118 is coupled (e.g., attached, fastened, adhered, etc.) to a surface (e.g., wall, etc.), shown as a ceiling 121. For example, the body 118 may be attached to the ceiling 121 in a retrofit application.

The shower system 100 is operable in at least one configuration where the target 114 of the water propelled from the sprayer 110 is not on the panel 120 and at least one configuration where the target 114 of the water propelled from the sprayer 110 is on the panel 120. For example, the target 114 may be on the floor 116. In other examples, the target 114 may be located on a vertical wall. When water contacts the panel 120, the water is deflected. In this way, the shower system 100 utilizes the panel assembly 104 to cause water to drop (e.g., fall, etc.) onto the user. This effect may, for example, simulate a "rain" (e.g., rain-drop, etc.) experience.

The panel 120 includes a surface (e.g., face, etc.), shown as a deflection surface 122, upon which the target 114 may be located to cause the water to drop onto the user. The deflection surface 122 may include a plurality of features that are configured to provide various effects on the water propelled from the sprayer 110. In an exemplary embodiment, the deflection surface 122 is concave in shape. Depending on where the target 114 is located along the deflection surface 122, the water may drop onto the user differently (e.g., with a different effect, etc.) or may drop onto the user in different locations. Similar to the sprayer 110, the deflection surface 122 causes the water to fall along a trajectory (e.g., path, center line, axis, etc.), shown as a trajectory 124, towards a target (e.g., focal point, aim point, etc.), shown as a secondary target 126 (e.g., a final target, a spray target, etc.)

As shown in FIGS. 1 and 2, the shower system 100 is configured such that the shower head assembly 102 has a first configuration, shown in FIG. 1, where the target 114 is located along the floor 116 at a first location, and a second configuration, shown in FIG. 2, where the target 114 is located along the deflection surface 122 such that the secondary target 126 is located along the floor 116 at the first location. In this way, the shower system 100 may be utilized with the shower head assembly 102 in various configurations while the user is located in the same location.

As shown in FIG. 3, the target 114 may be positioned along floor 116 and/or the deflection surface 122, via placing the shower head assembly 102 in various configurations, such that the secondary target 126 is repositioned along the floor 116 and/or such that the water falls from the deflection surface 122 differently. For example, different portions (e.g., a front portion, a back portion, a middle portion, etc.) of the deflection surface 122 may cause the water to fall differently if the target 114 is portioned within that portion.

Figure 4B:
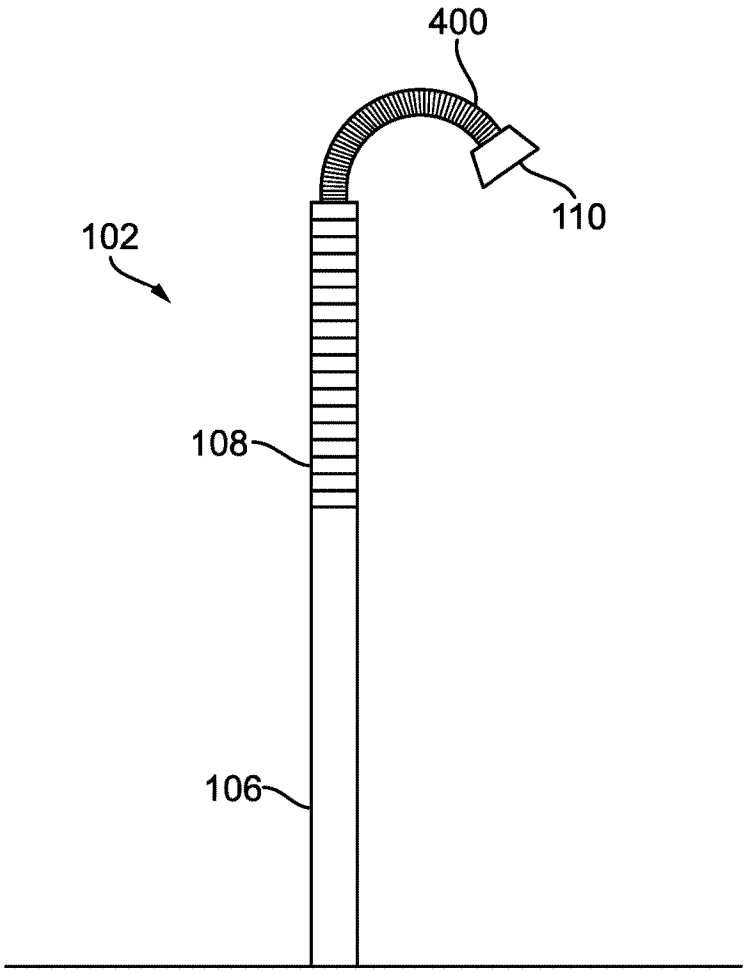
FIG. 4B is another front view of a shower head assembly for the shower system shown in FIG. 1 in an extended state, according to an exemplary embodiment of the present disclosure.
Figure 4A:
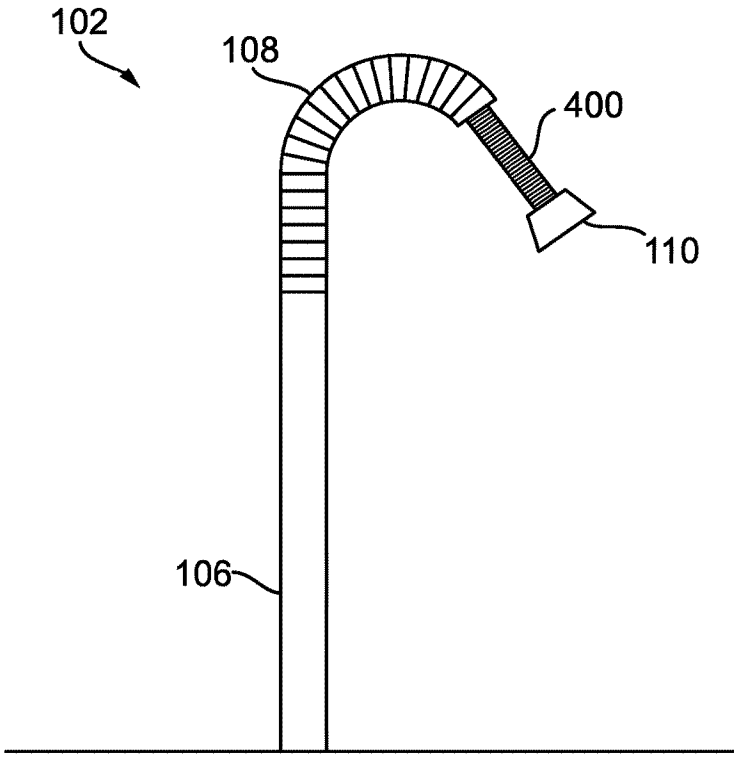
FIG. 4A is a front view of a shower head assembly for the shower system shown in FIG. 1 in an extended state, according to an exemplary embodiment of the present disclosure.

FIGS. 1-3 illustrate the shower head assembly 102 in a retracted state where the sprayer 110 is mated (e.g., coupled to, attached to, attached to, etc.) the movable head 108. In various embodiments, such as those shown in FIGS. 4A and 4B, the shower head assembly 102 is operable in an extended state. The sprayer 110 may be pulled from the movable head 108 such that the shower head assembly 102 enters the extended state. For example, the user may grasp the sprayer 110 when the shower head assembly 102 is in the retracted position and pull the sprayer 110 such that the sprayer 110 detaches from the movable head 108 and causing the shower head assembly 102 to be in the extended position.

When the shower head assembly 102 is in the extended position, the sprayer 110 draws a conduit (e.g., pipe, tube, flexible hose, etc.), shown as a flexible hose 400, from within the movable head 108. The flexible hose 400 facilitates movement of the sprayer 110 relative to the body 106. For example, the flexible hose 400 may allow the user to use the sprayer to propel water onto various surfaces of the user's body. The shower head assembly 102 may transition between the retracted state and the extended state regardless of the configuration in which the movable head 108 is being held. In some embodiments, causing the shower head assembly 102 to transition from the retracted state to the extended state causes a corresponding change in the configuration in which the movable head 108 is being held. For example, when the shower head assembly 102 is transitioned from the retracted state to the extended state, the movable head 108 may move from a first configuration, as shown in FIG. 2, to a second configuration, as shown in FIG. 1.

FIGS. 5A-5D illustrate the panel assembly 104 in greater detail according to various embodiments. The panel assembly 104 includes a plurality of features (e.g., protrusions, protuberances, projections, ribs, bumps, etc.), shown as deflection features 500, on the deflection surface 122. The deflection features 500 are configured to deflect water from the sprayer 110 towards the secondary target 126 (e.g., generally along the trajectory 124, etc.). The deflection features 500 are oriented with respect to an edge (e.g., face, side, etc.) of the deflection surface 122, shown as a leading edge 502, which is oriented towards the shower head assembly 102. Various shapes, sizes, and configurations of the deflection features 500 are included on the deflection surface 122. Different deflection features 500 cause water to be deflected in different ways (e.g., forming different sized droplets of water, etc.). By altering the shapes, sizes, and configuration of the deflection features 500, the "rain" experienced by the user can be varied. While various examples of the deflection features 500 are shown and described herein, it is understood that various other shapes, sizes, and configurations of the deflection features 500 are similarly possible.

Figure 5A:
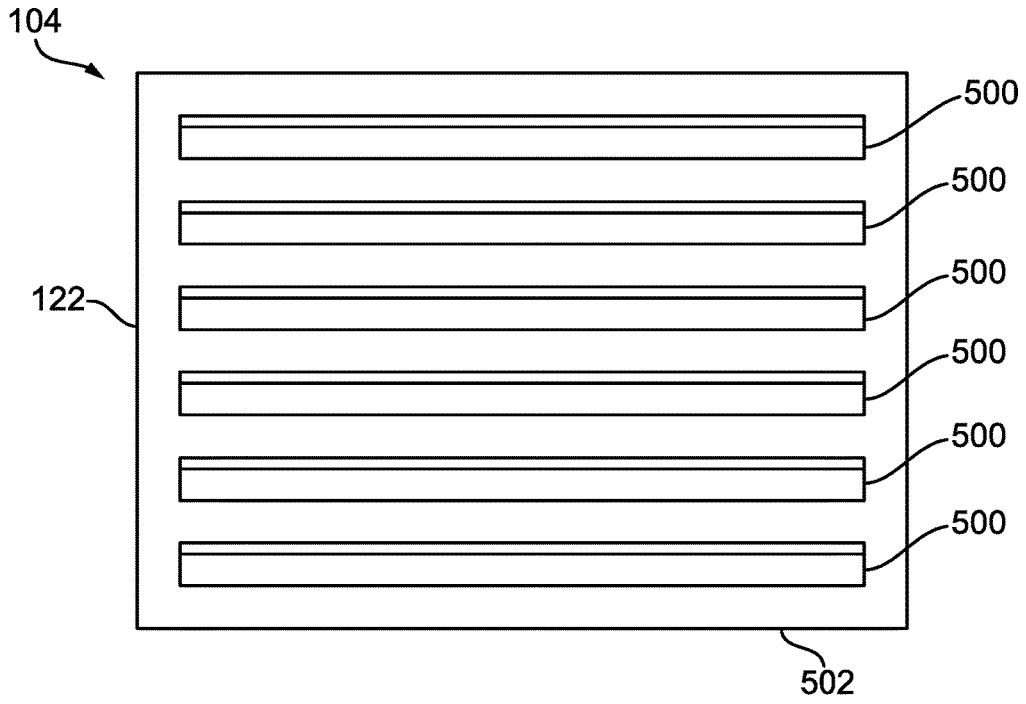
FIG. 5A is a bottom view of a panel assembly for use in a shower system, such as the shower system shown in FIG. 1, according to an exemplary embodiment of the present disclosure.
Figure 5B:
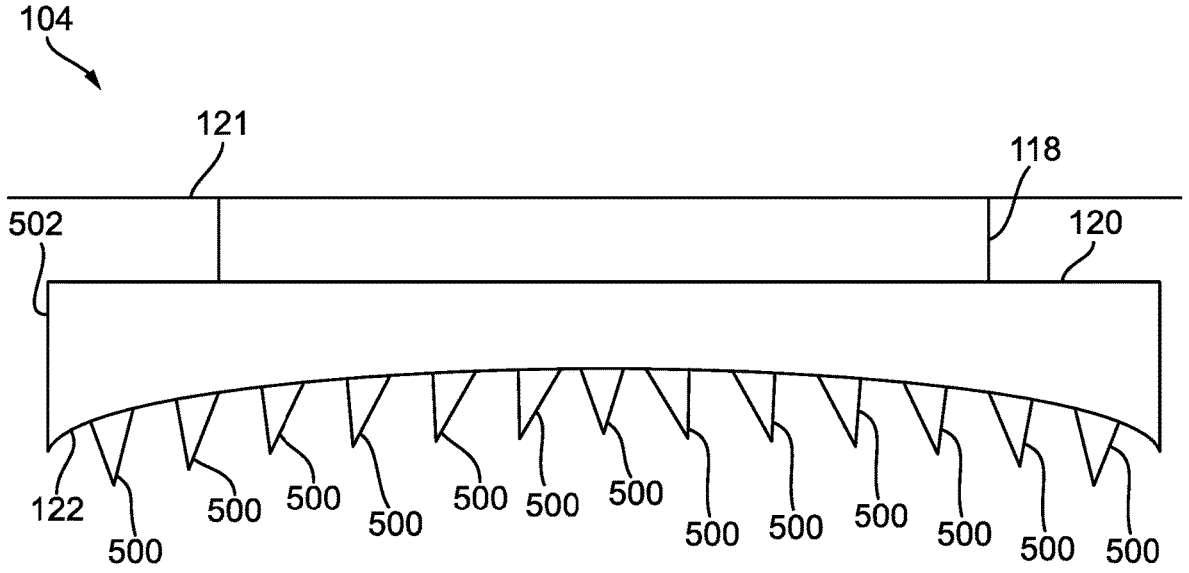
FIG. 5B is a side view of a panel assembly for use in a shower system, such as the shower system shown in FIG. 1, according to an exemplary embodiment of the present disclosure.
Figure 5C:
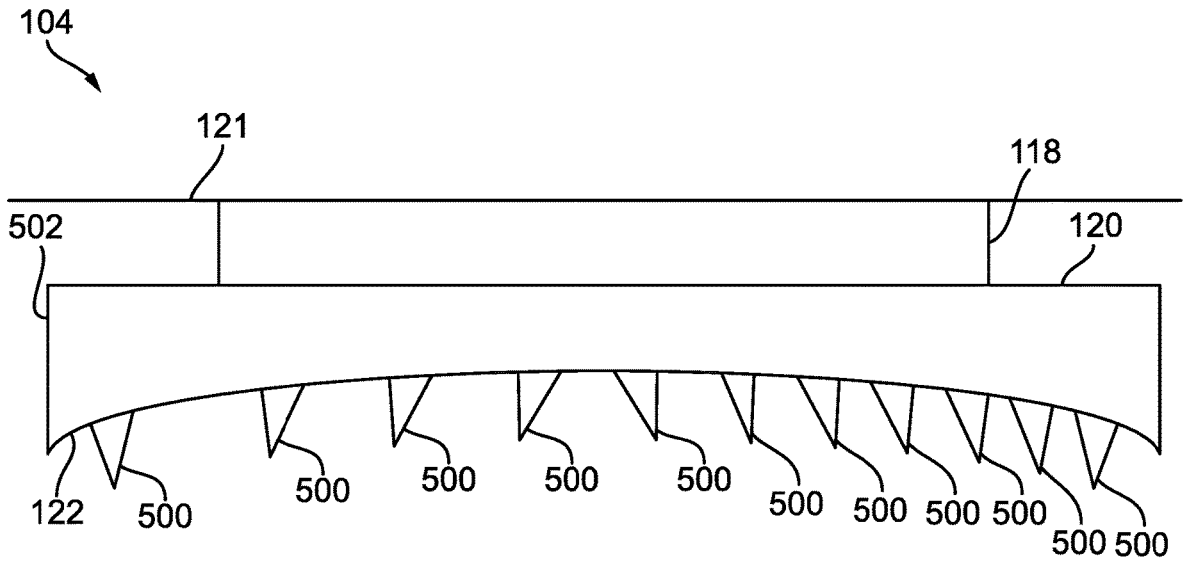
FIG. 5C is another side view of a panel assembly for use in a shower system, such as the shower system shown in FIG. 1, according to an exemplary embodiment of the present disclosure.
Figure 5D:
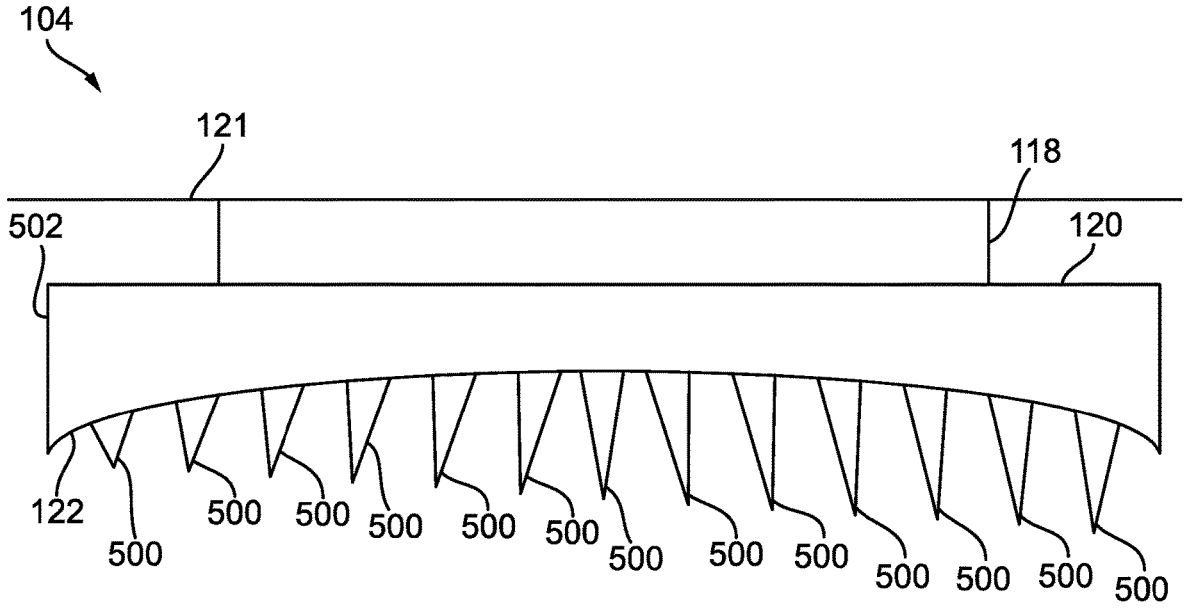
FIG. 5D is yet another side view of a panel assembly for use in a shower system, such as the shower system shown in FIG. 1, according to an exemplary embodiment of the present disclosure.

As shown in FIG. 5A, the panel assembly 104 includes a plurality of deflection features 500, each of which is an elongated projection that extends across the deflection surface 122. Each of the deflection features 500 is parallel to the leading edge 502. The deflection features 500 may be of various shapes, sizes, and configurations. As shown in FIGS. 5B and 5C, the deflection features 500 are all the same shape and same size relative to the deflection surface 122. In FIG. 5B, the deflection features 500 are evenly spaced along the deflection surface 122. In FIG. 5C, the deflection features 500 are least concentrated near the leading edge 502 and gradually more concentrated away from the leading edge 502 and towards a second edge (e.g., face, side, etc.) of the deflection surface 122, shown as a trailing edge 504. In other applications, the deflection features 500 are most concentrated near the leading edge 502 and gradually less concentrated away from the leading edge 502 and towards the trailing edge 504. As shown in FIG. 5D, the deflection features 500 gradually increase in size (e.g., height, etc.) from the leading edge 502 to the trailing edge 504. In other applications, the deflection features 500 gradually decrease in size from the leading edge 502 to the trailing edge 504.

Figure 6A:
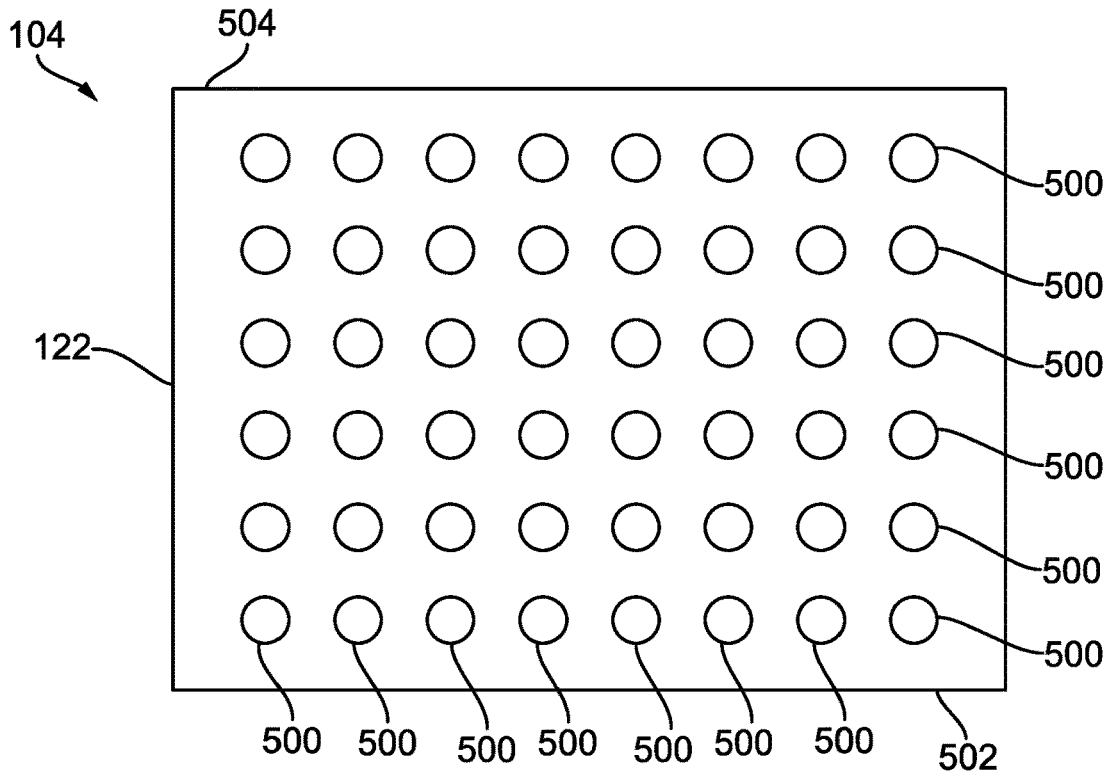
FIG. 6A is another bottom view of a panel assembly for use in a shower system, such as the shower system shown in FIG. 1, according to an exemplary embodiment of the present disclosure.
Figure 6B:
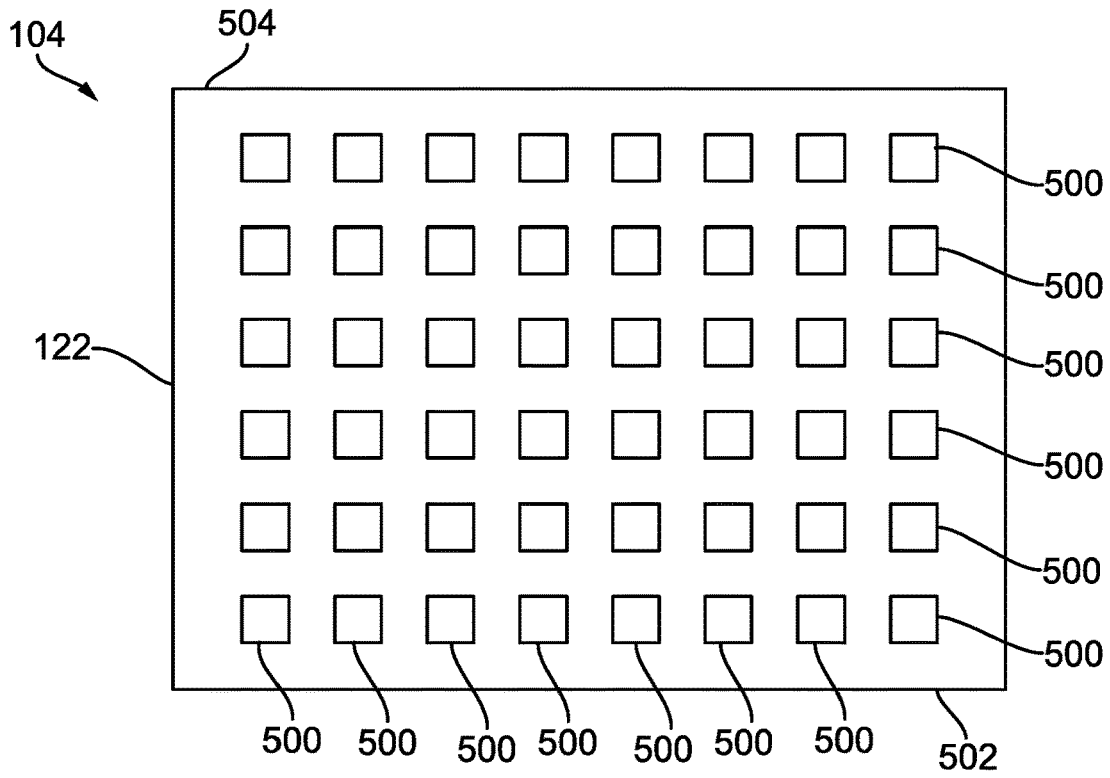
FIG. 6B is yet another bottom view of a panel assembly for use in a shower system, such as the shower system shown in FIG. 1, according to an exemplary embodiment of the present disclosure.
Figure 6C:
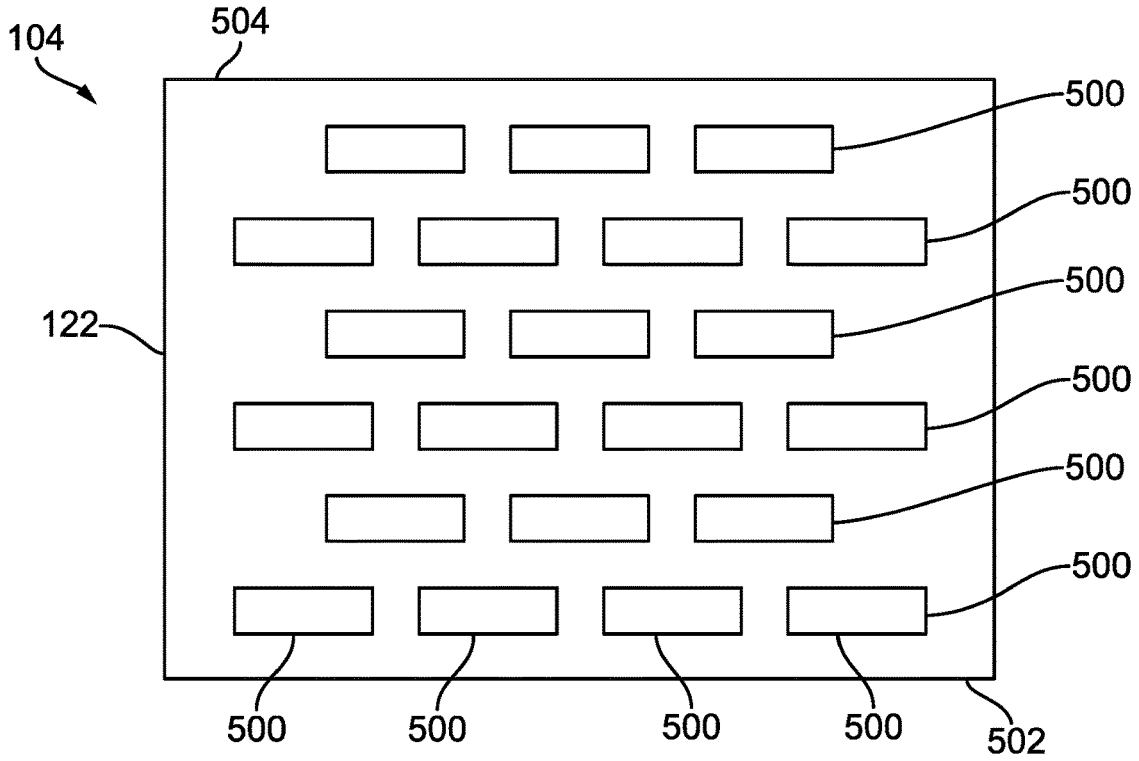
FIG. 6C is yet another bottom view of a panel assembly for use in a shower system, such as the shower system shown in FIG. 1, according to an exemplary embodiment of the present disclosure.
Figure 6D:
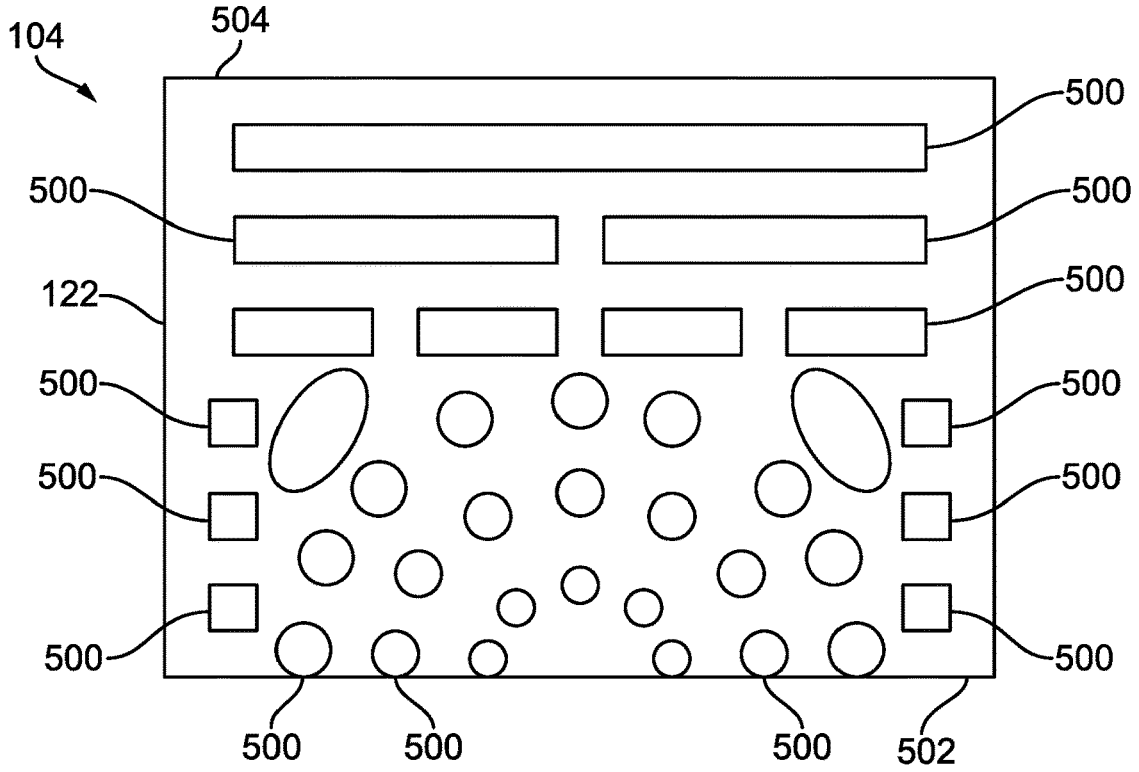
FIG. 6D is yet another bottom view of a panel assembly for use in a shower system, such as the shower system shown in FIG. 1, according to an exemplary embodiment of the present disclosure.
Figure 6E:
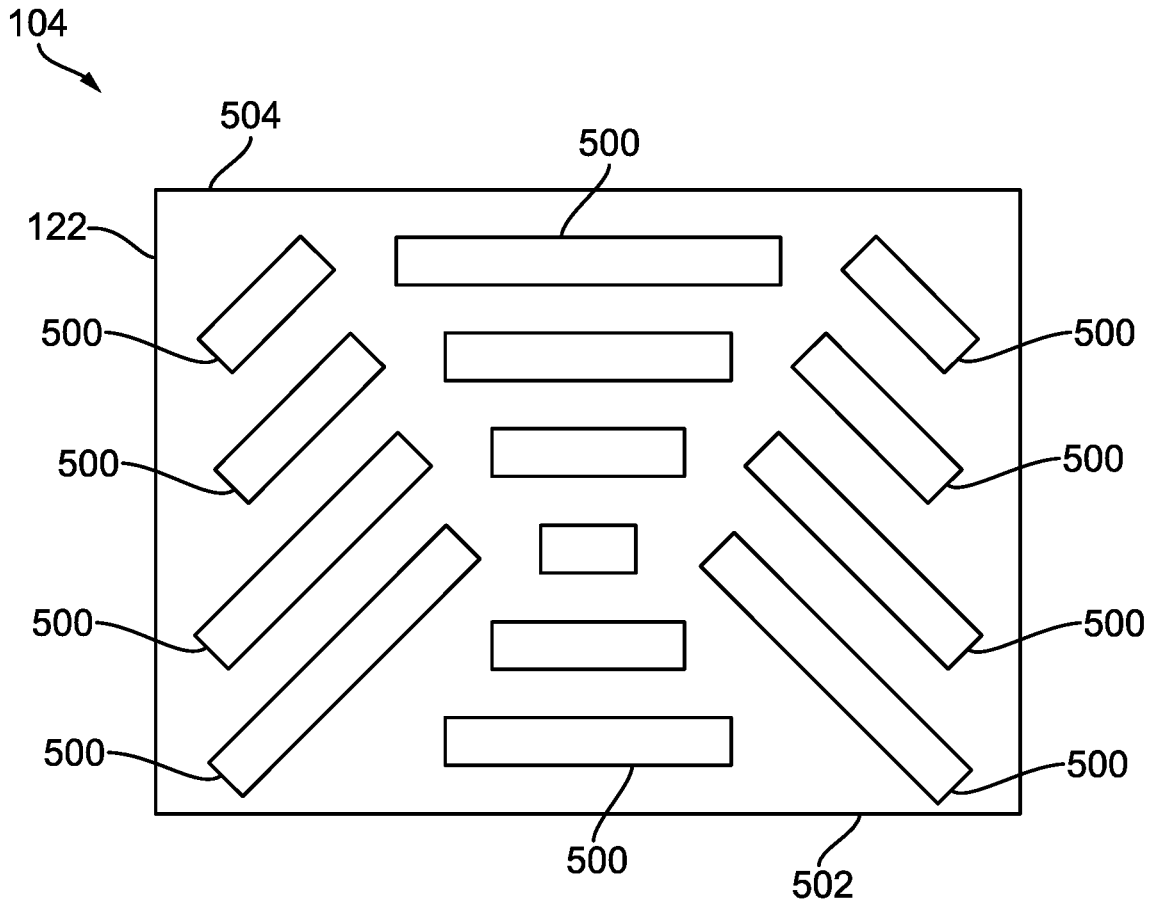
FIG. 6E is yet another bottom view of a panel assembly for use in a shower system, such as the shower system shown in FIG. 1, according to an exemplary embodiment of the present disclosure.

In some applications, as shown in FIGS. 6A-6E, the deflection features 500 may resemble posts (e.g., pegs, pins, etc.). For example, the deflection features 500 may resemble circular pegs, as shown in FIG. 6A, or square or rectangular pegs, as shown in FIG. 6B. In some applications, the deflection features 500 may be offset relative to other deflection features 500, as shown in FIG. 6C. As shown in FIG. 6D, different shapes and sizes of the deflection features 500 may be incorporated within the panel assembly 104. The deflection features 500 may also be angled relative to the leading edge 502 and/or the trailing edge 504. As shown in FIG. 6E, the deflection features 500 may be angled towards each other to funnel water towards other deflection features 500.

Figure 7A:
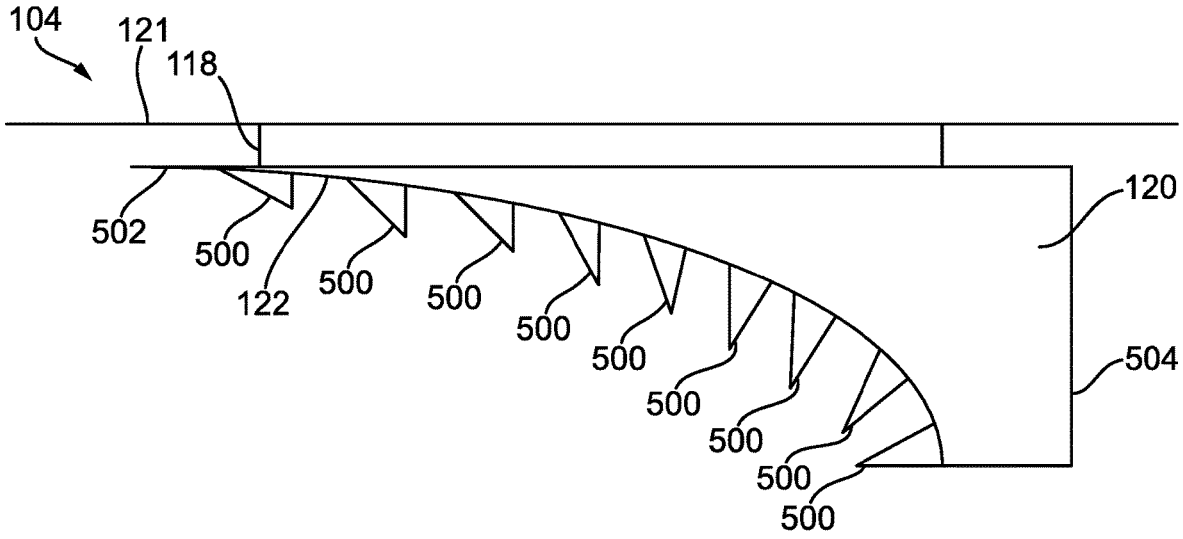
FIG. 7A is yet another side view of a panel assembly for use in a shower system, such as the shower system shown in FIG. 1, according to an exemplary embodiment of the present disclosure.
Figure 7B:
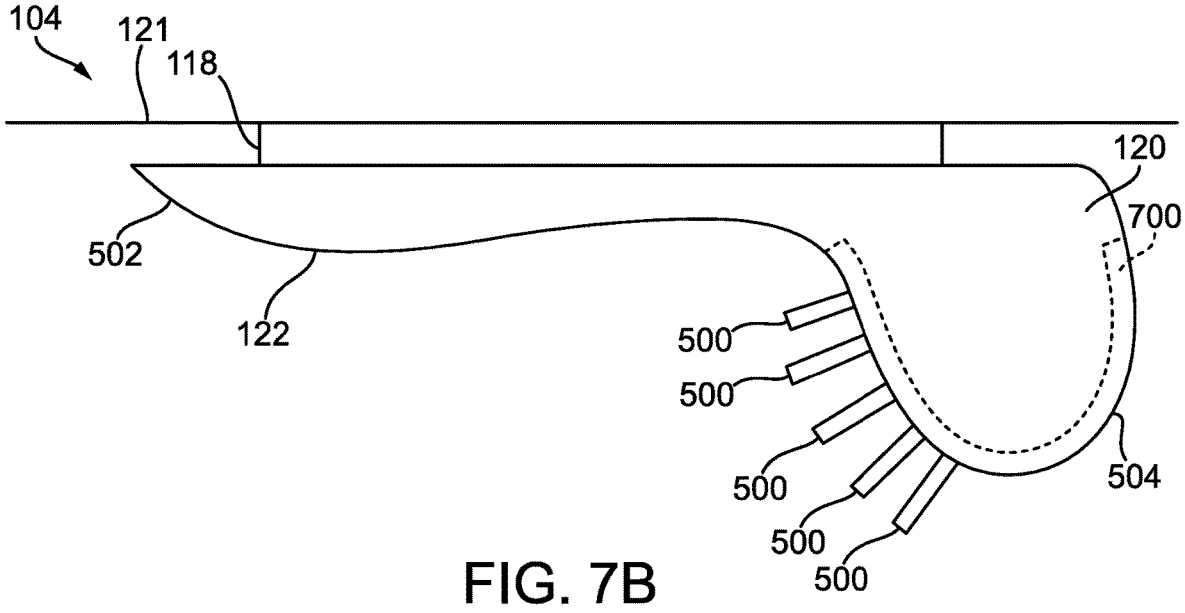
FIG. 7B is yet another side view of a panel assembly for use in a shower system, such as the shower system shown in FIG. 1, according to an exemplary embodiment of the present disclosure.

In other applications, as shown in FIGS. 7A and 7B, the panel 120 may be shaped or otherwise formed to assist the deflection surface 122 and/or deflection features 500 in directing the water along the trajectory 124 towards the secondary target 126. As shown in FIGS. 7A and 7B, a portion of the panel 120 proximate to the leading edge 502 is relatively thin compared to a portion of the panel 120 proximate to the trailing edge 504, thereby forming a partially-open concave shape. As shown in FIG. 7B, the deflection features 500 may only be located on a part of the deflection surface 122, such as within a region, shown as an extended region 700.

In some embodiments, the deflection surface 122, including the deflection features 500, is coated (e.g., treated, etc.) with a coating. For example, the deflection surface 122 may be treated with a hydrophobic coating. In other examples, the deflection surface 122 may be treated such that the deflection surface 122 provides relatively high surface tension.

Depending on the application, the panel assembly 104 may be selectively repositionable. For example, the panel assembly 104 may be controlled to tilt and/or rotate such that the deflection features 500 can be repositioned and water from the sprayer 110 can be directed towards the secondary target 126. In some applications, the shower system 100 includes a second panel assembly 104. The second panel assembly 104 may also be coupled to the ceiling 121. For example, the second panel assembly 104 may be coupled alongside the first panel assembly 104. Similarly, the shower system 100 may include three, four, or more of the panel assemblies 104. In some applications, the panel assembly 104, or an additional panel assembly 104, is coupled to a vertical wall (e.g., a rear wall opposite the body 106, etc.). Further, multiple panel assemblies 104 coupled to the ceiling 121 and/or a vertical wall can be configured to cooperate to direct water from the sprayer 110 towards the secondary target 126.

In some applications, lighting elements, fans, speakers, sensors, and other similar devices may be incorporated into the panel assembly 104. For example, fans may be integrated within the body 118 that draw steam produced, if any, from the shower system 100 and provide the steam to an exterior environment. In other examples, lighting elements may be integrated within the panel assembly 104 that illuminate an area proximate to the shower system. For example, the lighting elements may illuminate the target 114 and/or the secondary target 126.

In various embodiments, the panel assembly 104 is constructed from plastic. For example, the panel assembly 104 may be molded from plastic in a single piece such that the various components of the panel assembly 104 axe structurally integrated (e.g., as opposed to being fastened or attached together, etc.). Such a configuration of the panel assembly 104 may reduce manufacturing costs associated with the panel assembly 104 because various manufacturing steps (e.g., attaching the various components of the panel assembly 104, etc.) are eliminated.

As utilized herein, the terms "approximately," "about," "parallel," "substantially," and similar terms are intended to have a broad meaning in harmony with the common and accepted usage by those of ordinary skill in the art to which the subject matter of this disclosure pertains.

It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims. It is understood that the term "parallel" is intended to encompass de minimis variations as would be understood to be within the scope of the disclosure by those of ordinary skill in the art.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled," "connected," and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shower system 100, the shower head assembly 102, the panel assembly 104, and all other elements and assemblies as shown in the exemplary embodiments are illustrative only. Additionally, any element disclosed in one embodiment may be incorporated or utilized with any other embodiment disclosed herein. For example, the extended region 700 of the exemplary embodiment described in at least paragraph [0045] may be incorporated in the deflection surface 122 of the exemplary embodiment described in at least paragraphs [0042] and [0043]. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A shower system comprising:

a panel configured to be mounted on a ceiling within a showering enclosure, the panel comprising a deflection surface that includes a plurality of deflection features that are configured to redirect water that is incident upon at least one of the plurality of deflection features at an upward angle toward a location directly beneath the panel.

2. The shower system of claim 1, further comprising a showerhead configured to direct water upward toward the panel at an angle.

3. The shower system of claim 2, wherein the showerhead is repositionable between a number of different positions.

4. The shower system of claim 1, wherein the panel includes a base configured to be mounted to the ceiling and the panel is coupled to the base.

5. The shower system of claim 1, wherein the each of the plurality of deflection features comprises an elongated projection extending from the deflection surface.

6. The shower system of claim 1, wherein the deflection surface is at least partially concave.

7. The shower system of claim 1, wherein the plurality of deflection features varies in size and shape.

8. The shower system of claim 7, wherein the deflection features at a middle of the panel are longer than the deflection features toward outer edges of the panel.

9. A shower system comprising:

a panel configured to be mounted on a ceiling within a showering enclosure, the panel comprising a deflection surface that includes a plurality of deflection features protruding from the deflection surface, each of the plurality of deflection features configured to redirect water that is incident upon at least one of the plurality of deflection features at an upward angle toward a location directly beneath the panel, at least two of the plurality of deflection features having at least one of an identical size or an identical shape; and a showerhead configured to direct water upward toward the panel at an angle.

10. The shower system of claim 9, wherein the showerhead is repositionable between a number of different positions.

11. The shower system of claim 9, wherein the panel includes a base configured to be mounted to the ceiling and the panel is coupled to the base.

12. The shower system of claim 9, wherein the each of the plurality of deflection features comprises an elongated projection extending from the deflection surface.

13. The shower system of claim 9, wherein the deflection surface is at least partially concave.

14. The shower system of claim 9, wherein the plurality of deflection features varies in size and shape.

15. A shower system comprising:

a panel configured to be mounted on a ceiling, the panel comprising a deflection surface that includes a plurality of deflection features protruding from the deflection surface, each of the plurality of deflection features configured to redirect water that is incident upon at least one of the plurality of deflection features at an upward angle toward a location beneath the panel; and a showerhead configured to direct water upward toward the panel at an angle;

wherein the deflection surface is configured such that when the water is redirected toward the location, the water interfaces with at least two of the plurality of deflection features.

16. The shower system of claim 15, wherein the showerhead is repositionable between a number of different positions.

17. The shower system of claim 15, wherein the panel includes a base configured to be mounted to the ceiling and the panel is coupled to the base.

18. The shower system of claim 15, wherein the each of the plurality of deflection features comprises an elongated projection extending from the deflection surface.

19. The shower system of claim 15, wherein the deflection surface has a curved surface from which the deflection features protrude.

20. The shower system of claim 15, wherein the plurality of deflection features varies in size and shape.

* * * * *